US005940042A

United States Patent [19]

Van Hoozen

[11] Patent Number: 5,940,042

[45] **Date of Patent: *Aug. 17, 1999**

[54] WINDSHIELD SLOT ANTENNA FOR VEHICLE TRANSMISSIONS

[75] Inventor: Allen L. Van Hoozen, Schaumberg, Ill.

[73] Assignee: Northrop Grumman Corporation, Los Angeles, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/926,259

[22] Filed: Sep. 5, 1997

[51] Int. Cl.[6] ..... H01Q 1/32; H01Q 13/10

[52] U.S. Cl. ..... 343/713; 343/713; 343/712; 343/711

[58] Field of Search ..... 343/713, 711, 343/712

[56] References Cited

U.S. PATENT DOCUMENTS

| | | | |
|---|---|---|---|
| 2,923,813 | 2/1960 | Davis | 343/713 |
| 4,124,851 | 11/1978 | Aaron et al. | 343/772 |
| 4,999,642 | 3/1991 | Wells | 343/822 |
| 5,177,494 | 1/1993 | Dorrie et al. | 343/713 |
| 5,214,436 | 5/1993 | Hannan | 343/705 |
| 5,355,144 | 10/1994 | Walton et al. | 343/713 |
| 5,602,558 | 2/1997 | Urakami et al. | 343/850 |
| 5,610,619 | 3/1997 | Zafar | 343/713 |
| 5,631,611 | 5/1997 | Luu | 333/17.3 |

*Primary Examiner*—Don Wong
*Assistant Examiner*—James Clinger
*Attorney, Agent, or Firm*—Terry J. Anderson; Karl J. Hoch, Jr.

[57] ABSTRACT

A vehicle slot antenna system including a vehicle having generally interconnected metal parts, a window frame integral with the vehicle, and a connector having two electrically conductive conduits each extending to the window frame from an impedance matching module in communication with a radio signal generator and/or receiver. The window frame has first and second substantially parallel metal border members whose perimeters form a slot and wherein perimeter sites of a window can be retained, with the slot being functional as a slot antenna. Such functionality is achieved through having one conduit of the connector in communication with the first border member of the window frame and the other conduit thereof in communication with the second border member of the window frame. The vehicle functions as a contoured metal ground plane having sufficient metal-to-metal interconnections to enable window frame utility as a slot antenna. The present invention additionally includes methodology for transmitting radio signals or for receiving radio signals by employing the slot antenna system in the vehicle and appropriately powering transmission or reception, respectively, of a signal generator or receiver device. The system here defined permits usage of integral structures of a vehicle without invasive mounting requirements or significant antenna visibility.

24 Claims, 1 Drawing Sheet

WINDSHIELD SLOT ANTENNA FOR VEHICLE TRANSMISSIONS

FIELD OF THE INVENTION

This invention relates in general to vehicle antennas, and in particular to a vehicle slot antenna system primarily formed of first and second substantially parallel metal border members of a window frame integral with the vehicle and within which perimeter sites of a window such as a windshield can be retained.

BACKGROUND OF THE INVENTION

While traditional antennas for vehicles such as automobiles, trucks, and the like generally are provided as so-called whip antennas mounted from fender or roof locations, it can be desirable to provide a hidden antenna for appearance and/or security purposes. With respect to the former consideration, the appearance of an automobile, for example, may be thought to be diminished by creating a hole in its body structure and mounting therefrom a whip antenna. Additionally, of course, rust, water leakage and the like can occur in association with an invasive mounting aperture. With respect to security factors, an exteriorly mounted antenna can be bent, broken, or stolen, with the latter two events resulting in loss of radio wave reception and/or transmission.

One attempt to address the above concerns provides for automatic retraction of an antenna when a radio is not in use. This approach aids in reducing antenna damage or theft, but it does not eliminate a mounting hole in the vehicle. Another attempt to solve exposed antenna problems resolves them by mounting an antenna within a windshield. However, and while wires employed are very thin, the wires in the windshield still are visible. This visibility may be unwanted for aesthetic reasons, or for security reasons such as confidentiality regarding the existence of any radio communication devices.

In view of the above concerns and potential disadvantages regarding traditional antennas, it is apparent that a need is present for a vehicle antenna system in which the antenna is secure. Accordingly, a primary object of the present invention is to provide a vehicle slot antenna system primarily formed of first and second substantially parallel metal border members of a window frame integral with the vehicle.

Another object of the present invention is to provide a vehicle slot antenna system wherein the window frame is situated as a front windshield frame or rear window frame.

Yet another object of the present invention is to provide a slot antenna system in communication with a dedicated emergency or "May Day" transmitter for assured transmission availability.

These and other objects of the present invention will become apparent throughout the description thereof which now follows.

SUMMARY OF THE INVENTION

The present invention is a vehicle slot antenna system comprising a vehicle having generally interconnected metal parts, a window frame integral with the vehicle, and a connector having two electrically conductive conduits each extending to the window frame from an impedance matching module in communication with a radio signal generator and/or receiver. The window frame has first and second substantially parallel metal border members whose perimeters form a slot wherein perimeter sites of a window can be retained, with the slot being functional as a slot antenna. Such functionality is achieved through having one conduit of the connector in communication with the first border member of the window frame and the other conduit thereof in communication with the second border member of the window frame. Preferably, the window frame is situated for a front windshield or a rear window of the vehicle to thereby respectively produce forward and upward or rearward and upward fields of view. The vehicle itself functions as a contoured metal ground plane having sufficient metal-to-metal interconnections to enable window frame utility as a slot antenna. Especially desired is an application as an emergency "May Day" transmitter or other like broadcasting system operating in the approximate 3 to 150 MHz frequency range where a conformal and secure transmit antenna is desired and can utilize existing vehicle structures.

The present invention additionally includes methodology for transmitting radio signals from a radio signal generator of a vehicle, or for receiving radio signals at a radio signal receiver, by employing the slot antenna system in the vehicle and appropriately powering transmission or reception, respectively, of the generator or receiver device. The slot antenna system here defined permits usage of integral structures of a vehicle without invasive mounting requirements or significant antenna visibility. In this manner, both appearance and security of a vehicle can be accomplished and maintained while providing signal transmission or reception capabilities as needed.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
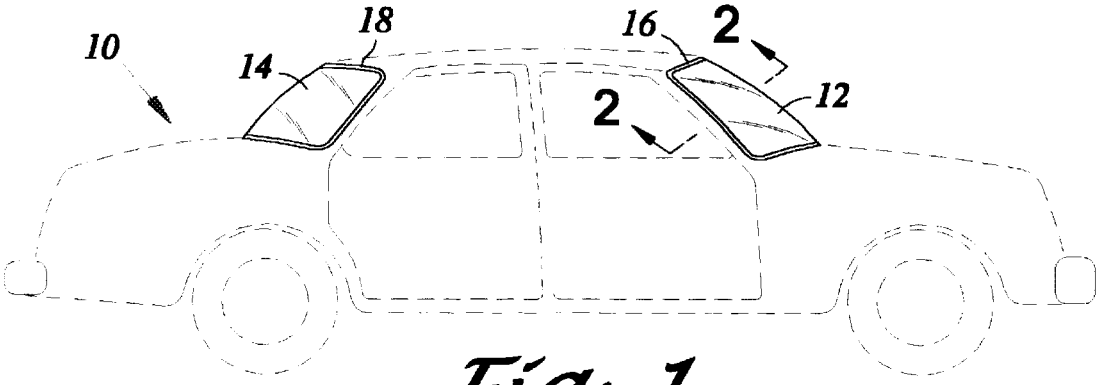
FIG. 1 is a side elevation view of a vehicle in phantom showing the front windshield and rear window with corresponding window frames.
Figure 2:
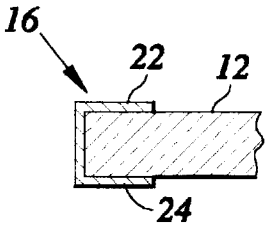
FIG. 2 is a cross sectional view along line 2—2 of FIG. 1.

Referring to FIG. 1, a vehicle 10 is shown in phantom lines to illustrate both the front windshield 12 and rear window 14 each having a respective frame 16, 18 integral with the vehicle 10. As shown in FIG. 2, a cross section of the frame 16, the perimeter of the windshield 12 is accommodated between first and second substantially parallel metal border members 22, 24.

Figure 3:
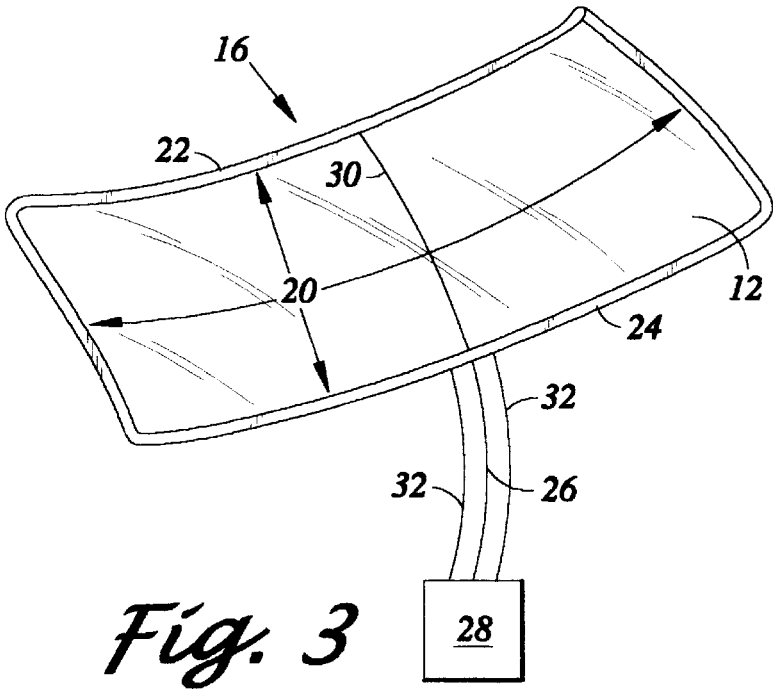
FIG. 3 is a perspective view of the windshield of FIG. 1.

FIG. 3 illustrates the frame 16 functioning as a slot antenna. In particular, a coaxial cable 26 is shown in connection with the frame 12. The cable 26 leads from a conventional impedance matching module 28 in communication with a radio signal generator or receiver (not shown), depending upon whether signals are to be sent or received. As shown, one conduit 30 of the cable 26 is connected to the first border member 22 of the window frame 12, while the other conduit 32 of the cable 26 is connected to the second border member 24 of the window frame 12. The slot 20 represented by the cross-sectional area occupied by the windshield 12 provides slot antenna functionality to the frame 16. In a like manner, the rear frame 18 accommodating the rear window 14 is identically constructed to thereby likewise have functionality as a slot antenna.

As earlier noted, the vehicle 10 itself functions as a contoured metal ground plane having sufficient metal-to-metal interconnections to enable window frame utility as a slot antenna. Slot antennas so constructed have particular utility in the approximately 3 to 150 MHz frequency range, and, while they are capable of sending or receiving radio signals, are especially preferred for use in May Day transmission systems for so-equipped vehicles. The front windshield frame 12 produces forward and upward fields of view, while the rear window frame 14 produces rearward and upward fields of view, thereby generally being able to provide receivable transmissions from a variety of terrains and conditions. The slot antenna system here described thus provides an efficient and effective mode for radio communications.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A vehicle slot antenna system comprising:

a) a vehicle having generally interconnected metal parts;

b) a separable window frame member integral with the vehicle and having a floor component and first and second substantially parallel metal border wall component members between which a slot is formed and within which border edges of a window is retained, said window frame member being functional as a slot antenna; and c) a connector having two electrically conductive conduits each extending from an impedance matching module that is in communication with a radio signal generator, with one conduit thereof in communication with the first border wall component member of the window frame member and the other conduit thereof in communication with the second border wall component member of the window frame member to thereby form a conductive slot antenna separable from the vehicle.

2. A vehicle slot antenna system as claimed in claim 1 wherein the window frame member is situated for a front windshield of the vehicle.

3. A vehicle slot antenna system as claimed in claim 1 wherein the window frame member is situated for a rear window of the vehicle.

4. A vehicle slot antenna system as claimed in claim 1 wherein the two electrically conductive conduits are formed as a coaxial cable.

5. A vehicle slot antenna system as claimed in claim 4 wherein one electrically conductive conduit is in communication with an upper site of one border wall component member of the window frame member and the other electrically conductive conduit is in communication with a lower site of the other border wall component member.

6. A vehicle slot antenna system as claimed in claim 1 wherein one electrically conductive conduit is in communication with an upper site of one border wall component member of the window frame member and the other electrically conductive conduit is in communication with a lower site of the other border wall component member.

7. A vehicle slot antenna system comprising:

a) a vehicle having generally interconnected metal parts;

b) a separable window frame member integral with the vehicle and having a floor component and first and second substantially parallel metal border wall component members between which a slot is formed and within which border edges of a window can be retained, said window frame member being functional as a slot antenna; and c) a connector having two electrically conductive conduits each extending from an impedance matching module that is in communication with a radio signal receiver, with one conduit thereof in communication with the first border wall component member of the window frame member and the other conduit thereof in communication with the second border wall component member of the window frame member to thereby form a conductive slot antenna separable from the vehicle.

8. A vehicle slot antenna system as claimed in claim 7 wherein the window frame member is situated for a front windshield of the vehicle.

9. A vehicle slot antenna system as claimed in claim 7 wherein the window frame member is situated for a rear window of the vehicle.

10. A vehicle slot antenna system as claimed in claim 7 wherein the two electrically conductive conduits are formed as a coaxial cable.

11. A vehicle slot antenna system as claimed in claim 10 wherein one electrically conductive conduit is in communication with an upper site of one border wall component member of the window frame and the other electrically conductive conduit is in communication with a lower site of the other border wall component member.

12. A vehicle slot antenna system as claimed in claim 7 wherein one electrically conductive conduit is in communication with an upper site of one border wall component member of the window frame and the other electrically conductive conduit is in communication with a lower site of the other border wall component member.

13. A method of transmitting radio signals from a radio signal generator of a vehicle, said vehicle having generally interconnected metal parts and a separable window frame member integral with the vehicle, said window frame member having a floor component and first and second substantially parallel metal border wall component members between which a slot is formed and within which border edges of a window can be retained, the method comprising:

a) placing an impedance matching module in communication with the radio signal generator, said module having extending therefrom two electrically conductive conduits;

b) placing one said electrically conductive conduit in communication with the first border wall component member of the window frame member and placing the other conduit in communication with the second border wall component member in a manner to effectuate functionality of said window frame member as a slot antenna to thereby form a conductive slot antenna separable from the vehicle; and c) powering the radio signal generator and transmitting therefrom radio signals.

14. A method as claimed in claim 13 wherein the window frame member is situated for a front windshield of the vehicle.

15. A method as claimed in claim 13 wherein the window frame member is situated for a rear window of the vehicle.

16. A method as claimed in claim 13 wherein the two electrically conductive conduits are formed as a coaxial cable.

17. A method as claimed in claim 16 wherein one electrically conductive conduit is in communication with an upper site of one border wall component member of the window frame member and the other electrically conductive conduit is in communication with a lower site of the other border wall component member.

18. A method as claimed in claim 13 wherein one electrically conductive conduit is in communication with an upper site of one border wall component member of the window frame member and the other electrically conductive conduit is in communication with a lower site of the other border wall component member.

19. A method of receiving radio signals at a radio signal receiver of a vehicle, said vehicle having generally interconnected metal parts and a window frame member integral with the vehicle, said window frame member having a floor component and first and second substantially parallel metal border wall component members between which a slot is formed and within which border edges of a window can be is retained, the method comprising:

a) placing an impedance matching module in communication with the radio signal receiver, said module having extending therefrom two electrically conductive conduits;

b) placing one said electrically conductive conduit in communication with the first border wall component member of the window frame member and placing the other conduit in communication with the second border wall component member in a manner to effectuate functionality of said window frame member as a slot antenna to thereby form a conductive slot antenna separable from the vehicle; and c) powering the radio signal receiver and receiving thereat radio signals.

20. A method as claimed in claim 19 wherein the window frame member is situated for a front windshield of the vehicle.

21. A method as claimed in claim 19 wherein the window frame member is situated for a rear window of the vehicle.

22. A method as claimed in claim 19 wherein the two electrically conductive conduits are formed as a coaxial cable.

23. A method as claimed in claim 22 wherein one electrically conductive conduit is in communication with an upper site of one border wall component member of the window frame member and the other electrically conductive conduit is in communication with a lower site of the other border wall component member.

24. A method as claimed in claim 19 wherein one electrically conductive conduit is in communication with an upper site of one border wall component member of the window frame member and the other electrically conductive conduit is in communication with a lower site of the other border wall component member.

* * * * *